US006412703B2

(12) United States Patent
Yano et al.

(10) Patent No.: US 6,412,703 B2
(45) Date of Patent: Jul. 2, 2002

(54) EXPANSION VALVE

(75) Inventors: Masamichi Yano; Kazuhiko Watanabe, both of Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/861,517

(22) Filed: May 22, 2001

Related U.S. Application Data

(62) Division of application No. 09/246,157, filed on Feb. 8, 1999, now Pat. No. 6,241,157.

(30) Foreign Application Priority Data

Mar. 18, 1998 (JP) ..... 10-068352
Aug. 18, 1998 (JP) ..... 10-231452

(51) Int. Cl.[7] ..... F25B 41/04
(52) U.S. Cl. ..... 236/92 B; 62/225; 62/299
(58) Field of Search ..... 236/92 B; 62/225, 62/299; 137/507; 248/223.21

(56) References Cited

U.S. PATENT DOCUMENTS

| | | | | | |
|---|---|---|---|---|---|
| 1,799,668 | A | * | 4/1931 | Astrup | 248/223.21 |
| 2,862,991 | A | | 12/1958 | Reardon | 248/506 |
| 3,197,167 | A | | 7/1965 | Sturgis | 248/500 |
| 3,198,480 | A | * | 8/1965 | Morse | 62/299 |
| 3,277,844 | A | | 10/1966 | Hakenson | 248/501 |
| 3,762,180 | A | | 10/1973 | Jespersen | 62/223 |
| 3,810,366 | A | | 5/1974 | Orth | 62/217 |
| 4,431,117 | A | * | 2/1984 | Genbauffe et al. | 137/507 |
| 4,984,735 | A | | 1/1991 | Glennon et al. | 236/92 B |
| 5,467,611 | A | | 11/1995 | Cummings et al. | 62/299 |
| 5,630,329 | A | | 5/1997 | Nishishita et al. | 62/299 |
| 5,704,582 | A | | 1/1998 | Golembiewski et al. | 248/500 |
| 5,724,817 | A | | 3/1998 | Nishishita | 62/299 |

FOREIGN PATENT DOCUMENTS

| | | |
|---|---|---|
| EP | 0762063 A1 | 12/1997 |
| FR | 9615880 | 6/1998 |
| JP | 6-344765 | 12/1994 |
| JP | 9-26235 | 1/1997 |
| JP | 11-142026 | 5/1999 |

OTHER PUBLICATIONS

Copy of European Search Report dated Sep. 27, 2000.

* cited by examiner

*Primary Examiner*—William E. Tapolcal
(74) *Attorney, Agent, or Firm*—Armstrong, Westerman & Hattori, LLP

(57) ABSTRACT

An expansion valve 101 comprises a substantially prismatic-shaped valve body 301 made of aluminum alloy. On the valve body 301 is formed a first passage 32 through which a liquid-phase refrigerant travels towards an evaporator, and a second passage 34 through which a gas-phase refrigerant travels from the evaporator toward a compressor. On the upper portion of the valve body 301 is mounted a power element portion 36 for driving the valve mounted in the middle of a first passage 32. On the side surfaces 301*a* of the valve body 301 are formed protruding portions 301*c*, and to the protruding portions, penetrating holes 50 for inserting the bolt for mounting the expansion valve are formed.

3 Claims, 15 Drawing Sheets

EXPANSION VALVE

This application is a divisional of prior application Ser. No. 09/246,157, filed Feb. 8, 1999 now U.S. Pat. No. , 6,241,157.

BACKGROUND OF THE INVENTION

The present invention relates to an expansion valve for controlling the flow rate of a refrigerant to be supplied to an evaporator in a refrigeration cycle of a refrigerator, an air conditioning device and so on.

In the prior art, this type of expansion valves are used in the refrigeration cycle of an air conditioning device in vehicles, as disclosed in Japanese Laid-Open Patent Publication No. H9-26235. FIG. 17 shows a vertical cross-sectional view of a widely used prior art expansion valve with an outline of the refrigeration cycle. FIG. 18 is a schematic view of the valve body in the expansion valve, and FIG. 19 is a front view of the expansion valve viewed from direction A of FIG. 17. The expansion valve 10 comprises a valve body 30 made of aluminum alloy and having a substantially prismatic shape, to which are formed a first passage 32 of a refrigerant pipe 11 in the refrigeration cycle mounted in the portion from the refrigerant exit of a condenser 5 through a receiver 6 toward the refrigerant entrance of an evaporator 8 through which a liquid-phase refrigerant travels, and a second passage 34 of the refrigerant pipe 11 mounted in the portion from the refrigerant exit of the evaporator 8 toward the refrigerant entrance of a compressor 4 through which a gas-phase refrigerant travels. The passages are formed so that one passage is positioned above the other passage with a distance in between. Further, in FIGS. 18 and 19, reference number 50 shows bolt inserting holes for mounting the expansion valve 10.

On the first passage 32 is formed an orifice 32*a* where adiabatic expansion of the liquid-phase refrigerant supplied from the refrigerant exit of the receiver 6 is to be performed. On the entrance side of the orifice 32*a* or upper stream side of the first passage is formed a valve seat, and a spherical valve means 32*b* supported by the valve member 32*c* from the upper stream side is positioned on the valve seat. The valve member 32*c* is fixed to the valve means by welding, and positioned between a biasing means 32*d* of a compression coil-spring and the like, thereby transmitting the bias force of the biasing means 32*d* to the valve means 32*b*, and as a result, biasing the valve means 32*b* toward the direction approaching the valve seat.

The first passage 32 to which the liquid-phase refrigerant from the receiver 6 is introduced acts as the passage for the liquid-phase refrigerant, comprising an entrance port 321 connected to the receiver 6, and a valve chamber 35 connected to the entrance port 321. An exit port 322 is connected to the evaporator 8. The valve chamber 35 is a chamber with a bottom formed coaxially with the orifice 32*a*, and is sealed by a plug 39. The plug 39 is equipped with an o-ring 39*a*.

Moreover, the valve body 30 is equipped with a small radius hole 37 and a large radius hole 38, which is larger than the hole 37, which penetrates through the second passage 34 and are positioned coaxial to the orifice 32*a*, so as to provide driving force to the valve means 32*b* according to the exit temperature of the evaporator 8, and on the upper end of the valve body 30 is formed a screw hole 361 to which a power element portion 36 acting as a heat sensing portion is fixed.

Further, the valve body 30 includes a narrow portion 30*b* having a thin width whose width size $W_2$ is reduced (narrowed) compared to the width size $W_1$ of the portion where the bolt holes 50 exist, at the lower portion corresponding to the first passage 32 which is opposite to the upper portion where the power element portion 36 is to be mounted. The narrow portion contributes to lighten the weight and to reduce the cost of the parts used for the valve body 30.

The base-shape material (material formed to have the basic shape) of the valve body 30 is manufactured by an extrusion process of an aluminum alloy for example, and the bolt holes 50 are formed by a following drilling process.

The power element portion 36 comprises a diaphragm 36*a* made of stainless steel, an upper cover 36*d* and a lower cover 36*h* welded to each other with the diaphragm 36*a* positioned in between so as to each define an upper pressure housing 36*b* and a lower pressure housing 36*c* forming two sealed housing on the upper and lower areas of the diaphragm 36*a*, and a sealed tube 36*i* for sealing a predetermined refrigerant working as a diaphragm driving liquid into the upper pressure housing 36*b*, wherein the lower cover 36*h* is screwed onto the screw hole 361 with a packing 40. The lower pressure housing 36*c* is communicated to the second passage 34 through a pressure-equalizing hole 36*e* formed coaxial to the center axis of the orifice 32*a*. The refrigerant vapor from the evaporator 8 flows through the second passage 34, and therefore, the second passage 34 acts as a passage for the gas-phase refrigerant, and the pressure of the refrigerant gas is loaded to the lower pressure housing 36*c* through the pressure-equalizing hole 36*e*. Further, reference number 342 represents an entrance port from which the refrigerant transmitted from the evaporator 8 enters, and 341 represents an exit port from which the refrigerant transmitted to the compressor 4 exits.

Inside the lower pressure housing 36*c* contacting the diaphragm 36*a* is formed an aluminum heat sensing shaft 36*f* positioned slidably inside the large radius hole 38 penetrating the second passage 34, so as to transmit the refrigerant exit temperature of the evaporator 8 to the lower pressure housing 36*c* and to slide inside the large radius hole 38 in correspondence to the displacement of the diaphragm 36*a* accompanied by the difference in pressure between the lower pressure chamber 36*c* and the upper pressure chamber 36*b* in order to provide drive force, and a stainless steel operating shaft 37*f* having a smaller diameter than the heat sensing shaft 36*f* is positioned slidably inside the small radius hole 37 for pressing the valve means 32*b* against the elastic force of the biasing means 32*d* in correspondence to the displacement of the heat sensing shaft 36*f*, wherein the heat sensing shaft 36*f* is equipped with a sealing member, for example, an o-ring 36*g*, so as to secure the seal between the first passage 32 and the second passage 34. The upper end of the heat sensing shaft 36*f* contacts to the lower surface of the diaphragm 36*a* as the receiving portion of the diaphragm 36*a*, the lower end of the heat sensing shaft 36*f* contacts to the upper end of the operating shaft 37*f*, and the lower end of the operating shaft 37*f* contacts to the valve means 32*b*, wherein the heat sensing shaft 36*f* together with the operating shaft 37*f* constitute a valve drive shaft. Accordingly, the valve drive shaft extending from the lower surface of the diaphragm 36*a* to the orifice 32*a* of the first passage 32 is positioned coaxially inside the pressure-equalizing hole 36*e*. Further, a portion 37*e* of the operating shaft 37*f* is formed narrower than the inner diameter of the orifice 32*a*, which penetrates through the orifice 32*a*, and the refrigerant passes through the orifice 32*a*.

A known diaphragm drive liquid is filled inside the upper pressure housing 36*b* of the pressure housing 36*d*, and through the diaphragm 36*a* and the valve drive shaft exposed to the second passage 34 and the pressure equalizing hole 36*e* communicated to the second passage 34, the heat of the refrigerant vapor travelling through the second passage 34 from the refrigerant exit of the evaporator 8 is transmitted to the diaphragm drive liquid.

In correspondence to the heat being transmitted as above, the diaphragm drive liquid inside the upper pressure housing 36*b* turns into gas, the pressure thereof being loaded to the upper surface of the diaphragm 36*a*. The diaphragm 36*a* is displaced to the vertical direction according to the difference between the pressure of the diaphragm drive gas loaded to the upper surface thereof and the pressure loaded to the lower surface thereof.

The vertical displacement of the center are of the diaphragm 36*a* is transmitted to the valve means 32*b* through the valve drive shaft, which moves the valve means 32*b* closer to or away from the valve seat of the orifice 32*a*. As a result, the flow rate of the refrigerant is controlled.

Accordingly, the temperature of the low-pressure gas-phase refrigerant sent out from the exit of the evaporator 8 is transmitted to the upper pressure housing 36*b*, and according to the temperature, the pressure inside the upper pressure housing 36*b* is changed. When the exit temperature of the evaporator 8 rises, in other words, when the heat load of the evaporator is increased, the pressure inside the upper pressure housing 86*b* is raised, and correspondingly, the heat sensing shaft 36*f* or valve drive shaft is driven to the downward direction, pushing down the valve means 32*b*. Thereby, the opening of the orifice 32*a* is widened. This increases the amount of refrigerant being supplied to the evaporator 8, and lowers the temperature of the evaporator 8. In contrast, when the temperature of the refrigerant sent out from the evaporator 8 is lowered or heat load of the evaporator is reduced, the valve means 32*b* is driven to the opposite direction, narrowing the opening of the orifice 32*a*, reducing the amount of refrigerant being supplied to the evaporator, and raises the temperature of the evaporator 8.

The expansion valve 10 is mounted by bolt holes 50 to a predetermined member. FIG. 20 is a view explaining the mounting structure thereof, and in the drawing, a mounting member 60 is formed to have a plate-like shape, supporting two pipes 62 and 64. The pipe 62 is a pipe communicated to the compressor 4, and a tip portion 62*a* thereof is inserted to a port 341. In such state, a seal is formed between the pipe and the port by a seal ring 62*b*. The second pipe 64 is communicated to the receiver 6, and a tip portion 64*a* thereof is inserted to aport 321 through a seal 64*b*. Amounting member 70 is formed to have a plate shape, supporting two pipes 72 and 74.

The pipe 72 is communicated to the exit of the evaporator 8, and a tip portion 72*a* thereof is inserted to a port 342 through a seal 72*b*. The pipe 74 is communicated to the entrance of the evaporator 8, and a tip portion 74*a* thereof is inserted to a port 322 through a seal 74*b*. When fixing these mounting members 60 and 70 onto the body of the expansion valve 10, a bolt 80 is inserted to a bolt hole 66 formed on the mounting member 60. The bolt 80 is further inserted to a bolt hole 50 on the expansion valve 10 so as to penetrate therethrough, and a screw portion 82 on the tip of the bolt 80 is screwed onto a screw portion 76 of the second mounting member 70. By screwing the bolt 80, the tip portions of each pipes on each mounting member are inserted to respective ports of the expansion valve, and the fixing is completed. Further, the bolt hole 50 on the other side is also similarly fixed.

Moreover, in the prior art expansion valve, a plug body 36*k* may be used to seal the predetermined refrigerant as shown in FIG. 21 instead of using the sealed tube 36*i* as shown in FIG. 17. For example, a stainless steel plug body 36*k* may be inserted to a hole 36*j* formed on the upper cover 36*d* made of stainless steel so as to cover the hole, and the plug body 36*k* maybe fixed to the hole 36*j* by welding. Further, the operation for controlling the flow rate of the refrigerant by the valve is similar to that of FIG. 17, so FIG. 21 only shows the area related to the power element portion 36. FIG. 22 shows the schematic view of the valve body similar to FIG. 18 of the expansion valve but when the seal is performed by the plug body 36*k*, and the same reference numbers show the same components. In FIGS. 18 and 19, the sealed tube 36*i* is omitted.

SUMMARY OF THE INVENTION

In the prior art expansion valves, the bolt holes 50 for mounting the expansion valve is formed as a penetrating hole on the inner side of the both side surfaces 30*a* of the valve body 30 in the expansion valve. The bolt holes 50 must be formed in correspondence to the interval between the bolt holes 66 formed on the mounting member 60, and when the interval or pitch between the bolt holes formed on the mounting member are wide, the width size $W_1$ of the valve body 30 must also be widened. In this case, even if a narrow portion 30*b* having a width size of $W_2$ is formed on the lower portion of the valve body 30 corresponding to the first passage 32, there remains a problem that the cut-down on cost and weight may not be achieved.

The present invention aims at solving the above-mentioned problems, and the object is to provide an expansion valve which is capable of introducing bolt holes having necessary intervals, without having to increase the width size of the valve body greatly, even when the intervals of the bolt holes for mounting the expansion valve formed on the inner side of both side surfaces of the valve body is widened.

Moreover, the present invention aims at providing an expansion valve with a structure realizing the further cut-back on the weight and material cost of the valve body.

Even further, the present invention aims at providing an expansion valve having increased degree of freedom in mounting the piping to be connected to the expansion valve, enabling easy mounting of the piping to the expansion valve, and at the same time, having improved its workability.

In order to achieve the above-mentioned objects, the present invention provides an expansion valve comprising a valve body, a valve means for adjusting the flow rate of the refrigerant to be sent out to an evaporator, and a power element portion for driving said valve means according to the temperature of said refrigerant to be sent out to a compressor from said evaporator, wherein said valve body includes protruding portions formed integrally to the side surface of said valve body.

Moreover, in the preferred embodiment of the expansion valve according to the present invention, said protruding portions are formed to positions corresponding to where penetrating holes for mounting the expansion valve are to be formed.

Moreover, the embodiment of the expansion valve according to the present invention characterizes in that said penetrating holes are formed inside said valve body at positions separated from said protruding portions by a predetermined distance.

Further, the expansion valve according to the present invention is characterized in that said penetrating holes are formed on said protruding portions.

Even further, the present invention relates to an expansion valve comprising a valve body, a valve means for adjusting the flow rate of a refrigerant traveling through a first passage formed inside said valve body from a condenser toward an evaporator, and a power element portion for driving said valve means according to the temperature of the refrigerant traveling through a second passage formed inside said valve body from said evaporator toward a compressor, wherein said expansion valve includes protruding portions formed integrally to the side surfaces of said valve body corresponding to penetrating holes formed on said valve body for mounting the expansion valve.

Even further, according to the preferred embodiment of the present expansion valve, said valve body comprises a first narrow portion where the lower portion of the valve body opposite to the upper portion to which said power element portion is to be mounted is formed to have a narrow width, and a second narrow portion where the area of the valve body between said first narrow portion and said protruding portion is formed to have a narrow width.

Moreover, according to the embodiment of the present expansion valve, the valve body includes a third narrow portion where the area of said valve body between said protruding portion and said power element portion is formed to have a narrow width.

Further, the present expansion valve is characterized in that a mounting hole for fixing a pipe mounting member is formed to said protruding portions.

Even further, the present expansion valve comprises a prismatic valve body, a valve means for adjusting the flow rate of a refrigerant to be transmitted to an evaporator, and a power element portion for driving said valve means according to the temperature of the refrigerant transmitted from said evaporator to a compressor, wherein said valve body comprises prismatic projection formed integrally to the side surface of said valve body.

Moreover, the present expansion valve is characterized in that a mounting hole for fixing the pipe mounting member is formed to said projection.

The expansion valve of the present invention having the above-mentioned structure is formed to have protruding portions on the side surface of the valve body. Therefore, the position of the bolt mounting holes may be determined freely.

Further, the expansion valve of the present invention comprises a plurality of narrow portions formed on the valve body, so the cost for material and parts of the expansion valve may be reduced, even when the protruding portions are formed.

Moreover, the expansion valve of the present invention enables to increase the degree of freedom in mounting the piping to the expansion valve, and the mounting of the piping is simplified and the workability is increased.

PREFERRED EMBODIMENT OF THE INVENTION

The embodiment of the expansion valve according to the present invention will now be explained with reference, to the accompanied drawings. In the explanation of the embodiments, the same reference numbers as the above prior art explanation refer to either the same or equivalent portions, and they perform the same function.

Figure 1:
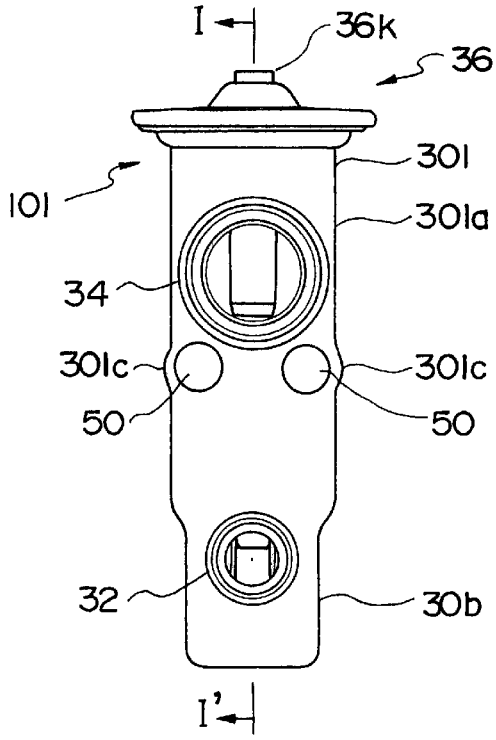
FIG. 1 is a front view showing one embodiment of the expansion valve according to the present-invention.
Figure 2:
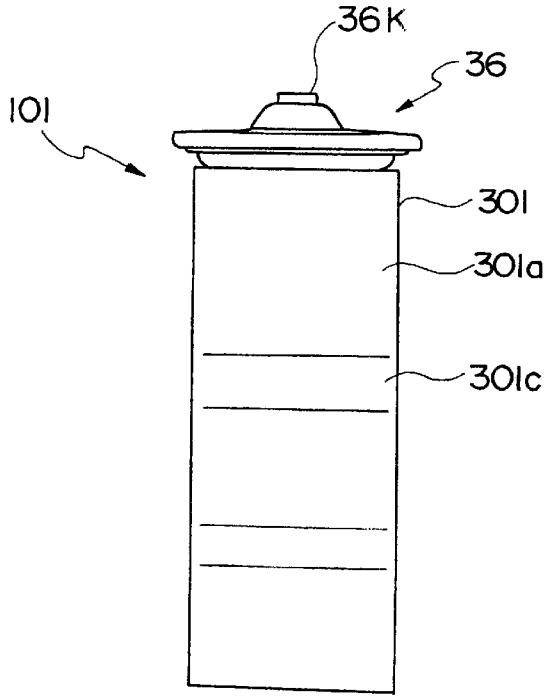
FIG. 2 is a side view showing one embodiment of the expansion valve according to the present invention.
Figure 3:
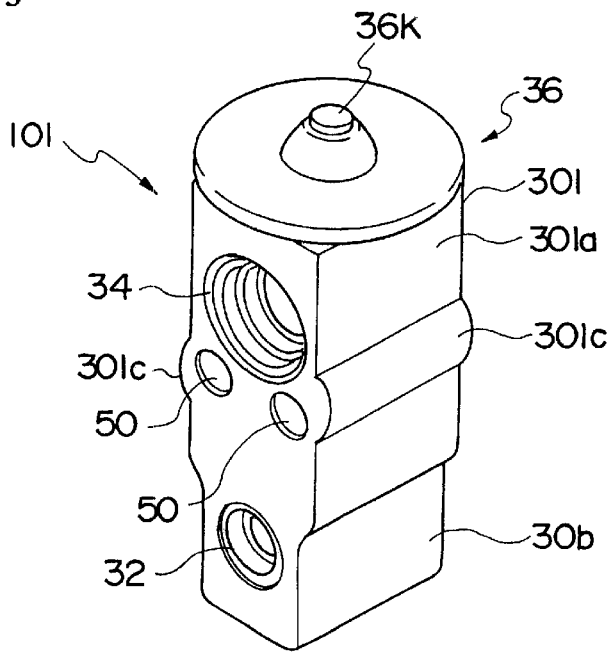
FIG. 3 is a schematic view showing one embodiment of the expansion valve according to the present invention.
Figure 4:
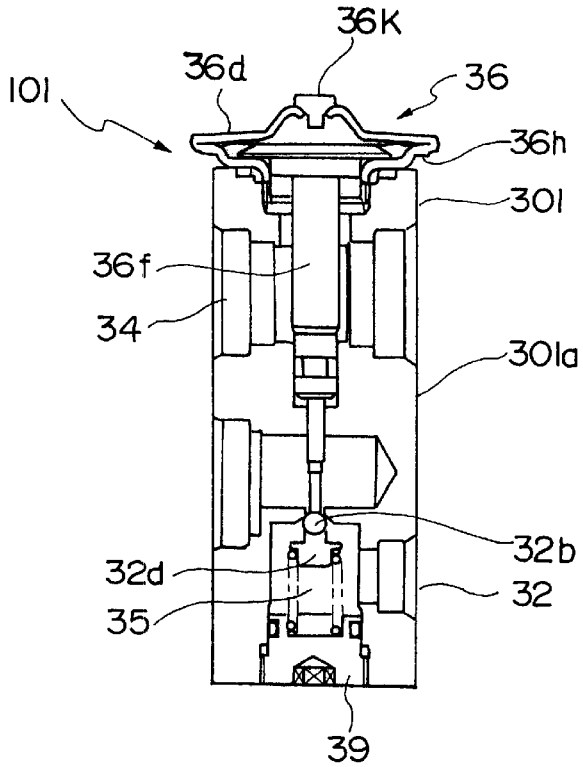
FIG. 4 is a cross-sectional view taken at line I–I' of FIG. 1.

FIG. 1 is a front view of an expansion valve 101 showing one embodiment of the expansion valve according to the present invention, FIG. 2 is a side view thereof, and FIG. 3 is a schematic view of the expansion valve 101 omitting the interior structure. FIG. 4 is a cross-sectional view taken at line I–I' of FIG. 1, omitting the refrigeration cycle. The expansion valve 101 shown in FIGS. 1–4 only differ from the prior art expansion valve 10 in that a protruding portion 301*c* is formed on the side surfaces 301*a* of the valve body 301. The other structures and operations are the same as the expansion valve 10 of the prior art, so the explanation thereof are omitted. The protruding portions 301*c* are formed integrally on the side surfaces 301*c* of the valve body 301, in a position corresponding to the where the penetrating mounting holes 50 of the valve body 301 will be formed.

By the protruding portions 301*c*, penetrating holes 50 may be formed having an interval corresponding to the interval between bolt holes 66 formed on the mounting members 60, 70. That is, even if the interval between the bolt holes 66 on the mounting members 60 and 70 are widened, the valve body may correspond to the widening of the interval of bolt holes 66 merely by placing the penetrating holes 50 closer to the protruding portion 301*c*, without having to widen the width size of the valve body 301.

Figure 5:
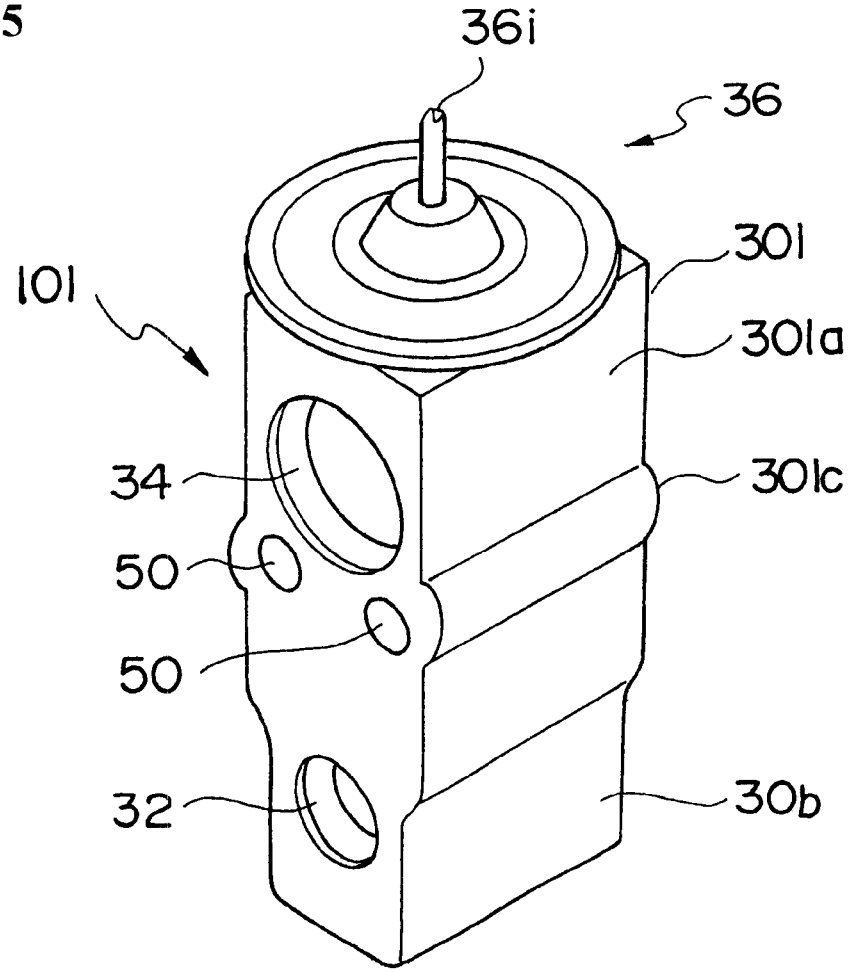
FIG. 5 is a schematic view showing another embodiment of the expansion valve according to the present invention.

Therefore, by forming the protruding portions 301*c*, the degree of freedom in the positioning of penetrating holes 50 may be secured. Moreover, FIG. 5 is a schematic view showing the embodiment where a sealed tube 36*i* is used for the power element portion 36, and the same reference numbers as FIG, 4 refer to the same components.

Figure 6:
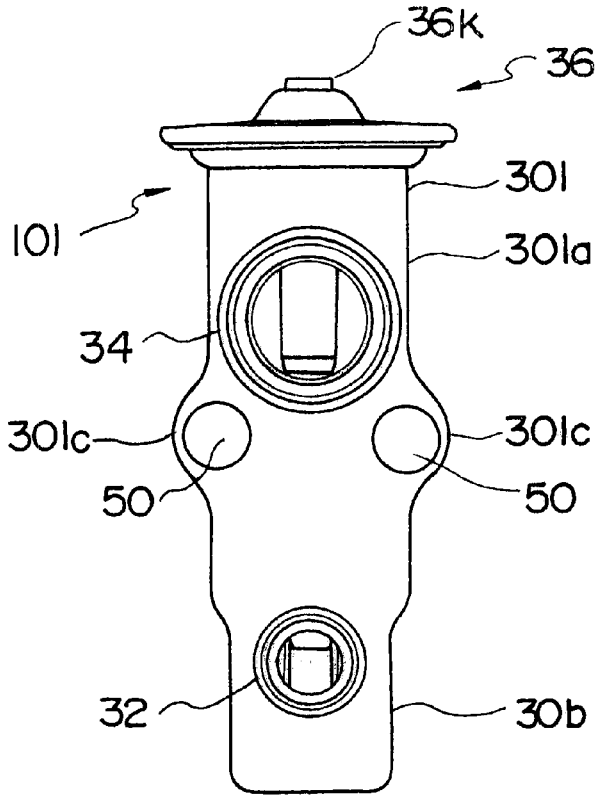
FIG. 6 is a front view showing another embodiment of the expansion valve according to the present invention.

Moreover, in the present embodiment, the base-shape material of the valve body 301 is formed by an extrusion process. The protruding portions 301*c* of the body are formed integrally when manufacturing the base-shape material. Accordingly, the penetrating holes 50 are formed by drilling holes to positions on the protruding portion 301*c* having a predetermined interval. FIG. 6 is a front view showing the case where penetrating holes 50 are formed at positions on the protruding portions 301*c*.

Further, penetrating holes 50 having predetermined intervals may also be formed simultaneously when manufacturing the base-shape material together with the protruding portions 301*c*, so as to omit the following drilling process. Moreover, the penetrating holes 50 may also be formed simultaneously by the hollow extrusion process together with a second passage penetrating the valve body 301 positioned parallel to the holes 50.

In the above explanation, protruding portions 301*c* are formed on the valve body 301 of the expansion valve so as to increase the degree of freedom in the position to which penetrating holes 50 may be formed. If, however, the cost of parts are increased by forming the above-mentioned protruding portions, then the cost of parts may be reduced by forming a narrow portion on plurality of positions on the valve body in the present expansion valve.

Figure 7:
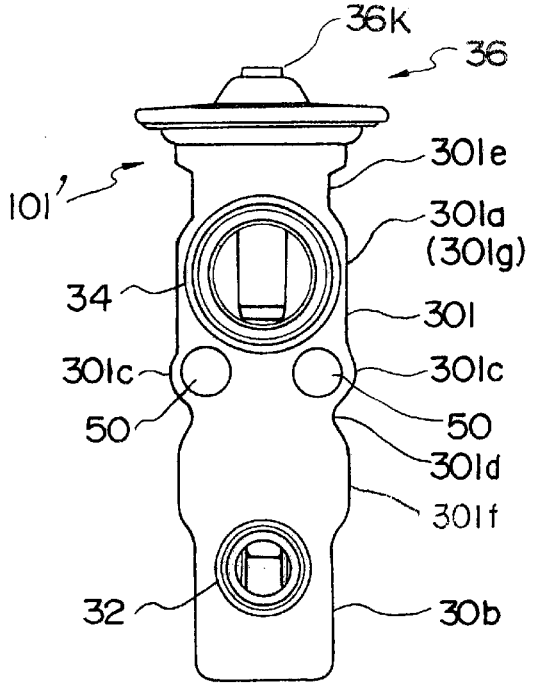
FIG. 7 is a front view showing another embodiment of the expansion valve according to the present invention.
Figure 8:
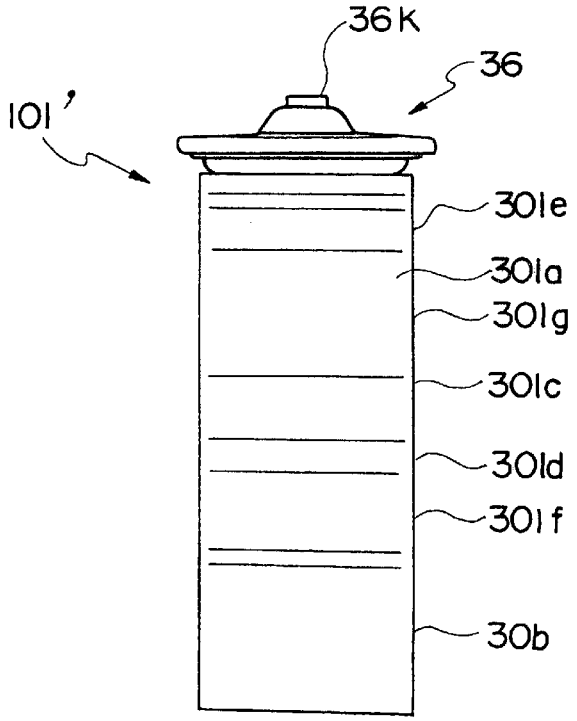
FIG. 8 is a side view of FIG. 7.

FIG. 7 is a front view showing another embodiment of the expansion valve according to the present invention, wherein narrow portions are formed on a plurality of areas in the valve body of the expansion valve, and FIG. 8 is a side view thereof.

In FIGS. 7 and 8, the same reference numbers as used in the expansion valve of FIGS. 1 through 4 refer to either the same or equivalent components, and in the expansion valve 101', narrow portions 30*b* (hereinafter called the first narrow portion) formed on the lower portion opposite to said upper portion of the valve body 301 where the power element portion 36 is to be mounted is formed, together with second narrow portions 301*d*. The second narrow portions 301*d* are formed on the area between the protruding portions 301*c* and a flat area 301*f* continuing from the first narrow portion 30*b*.

Moreover, third narrow portions 301*e* are formed between the power element portion 36 and the protruding portions 301*c*, continuing to the flat areas 301*g* of the side surfaces 301*a*. Of course, only at least one of the second narrow portion 301*d* and the third narrow portion 301*e* may be formed.

A plurality of narrow portions are formed to the valve body by the formation of the second narrow portions 301*d* and/or the third narrow portions 301*e*together with the first narrow portions 30*b*. Even if the. cost of parts are increased by the formation of the protruding portions 301*c*, the cost and the weight may be reduced greatly by the formation of plurality of narrow portions. Moreover, the formation of the narrow portions by hollow extrusion process together with the protruding portions enable the achievement of providing an expansion valve having a greatly reduced manufacturing cost, since the portions may be formed simultaneously with the manufacturing of the base-shaped material.

The above explanation involved cases where mounting members 60, 70 and bolt holes 50 for fixing the expansion valve itself is used to connect the expansion valve to the piping for the refrigeration cycle. However, the present invention is not limited to such example, but can be applied to cases where the piping may be connected to the expansion valve separately as the fixing of said expansion valve.

Figure 9:
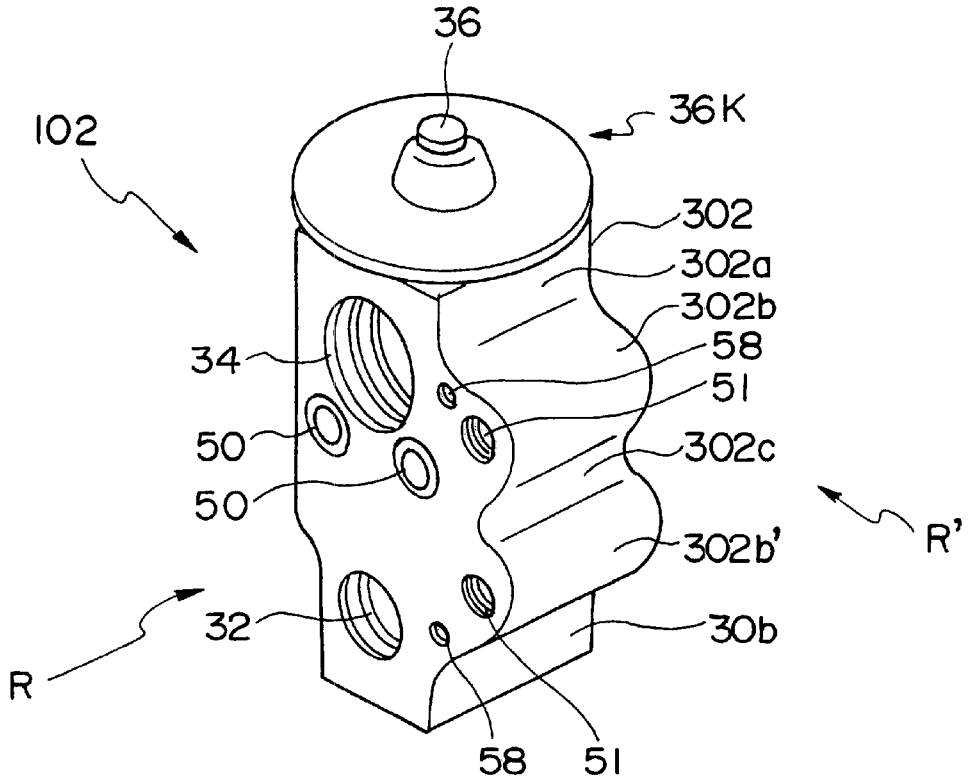
FIG. 9 is a schematic view showing another embodiment of the expansion valve according to the present invention.
Figure 10:
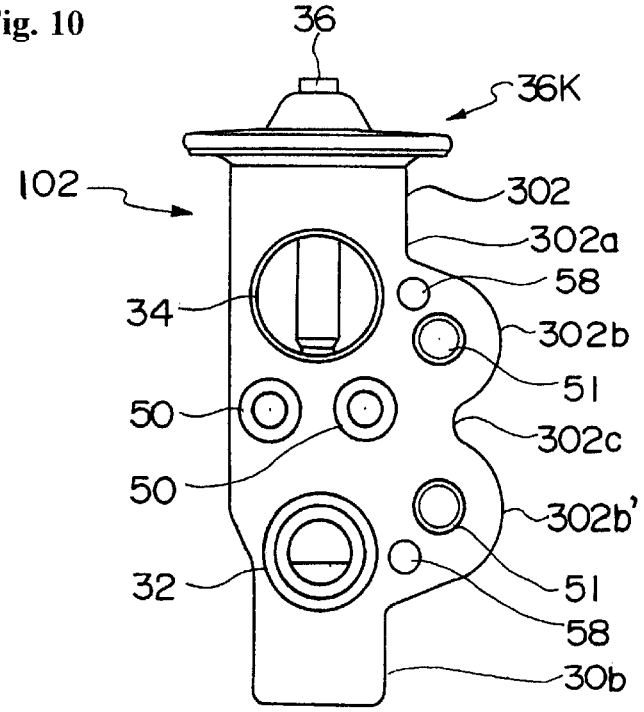
FIG. 10 is a front view of FIG. 9.
Figure 11:
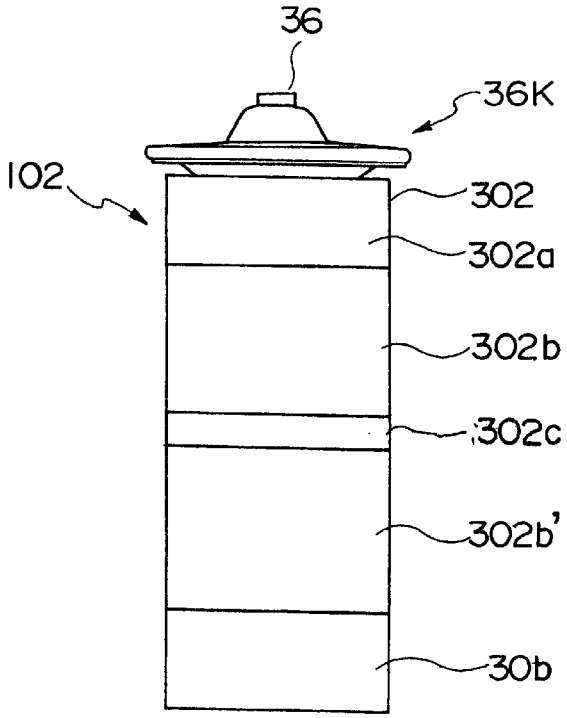
FIG. 11 is a side view of FIG. 9.

FIG. 9 shows an embodiment of an expansion valve 102 according to the above case, by a schematic view omitting its internal structure. FIG. 10 is a front view taken from direction arrow R of FIG. 9, and FIG. 11 is a side view taken from direction arrow R' of FIG. 9. Its internal structure is the same as FIG. 1 and is omitted from the drawing. In FIGS. 9 through 11, the expansion valve 102 is similar to the expansion valve 101 shown in FIGS. 1 through 3, except for protruding portions 302*b* and 302*b*' formed on the valve body 302 and mounting holes 51 formed on said protruding portions. Therefore, the same and similar portions of the expansion valve are marked by the same reference numbers, and the explanation thereof are omitted. The protruding portions 302*b* and 302*b*' are formed integrally to the side surface 302*a* of the valve body 302 by a hollow extrusion.

The extrusion process is performed toward the direction parallel to the refrigerant passage by use of an aluminum alloy and the like. Thereby, protruding portions 302*b*, 302*b*' and a concave portion 302*c* positioned between said protruding portions are formed integrally when manufacturing the base-shape material. Thereafter, the material is cut to an appropriate length as the valve body 302. Then, the first passage 32, the second passage 34 and the penetrating holes 50 are formed to the predetermined positions respectively by a hole forming process. Further, the mounting holes 51 are formed by a hole forming process to approximately the center area of the protruding portions 302*b* and 302*b*'. The mounting holes 51 may also be formed by a screwing process.

Moreover, except for the first passage 32, according to the present embodiment, the protruding portions 302*b* and 302*b*', the penetrating holes 50, the second passage 34 and the mounting holes 51 may also be formed simultaneously by a hollow extrusion process of an aluminum alloy and the like. In such case, the first passage 32 is formed by a hole forming process after the valve body 302 is cut. Further, a screwing process may be performed to the mounting holes 51.

Furthermore, the embodiment of FIG. 9 shows the case where the protruding portions 302*b* and 302*b*' are formed to have the same length as the width of the side surface 302*a* of the valve body 302. However, as for the length of the protruding portions, the two protruding portions may also be cut to an appropriate length after being formed. Thereby, the side surface of the valve body 302 having been removed of the two protruding portions maybe utilized, for example, as amounting space of the expansion valve 102.

Figure 12:
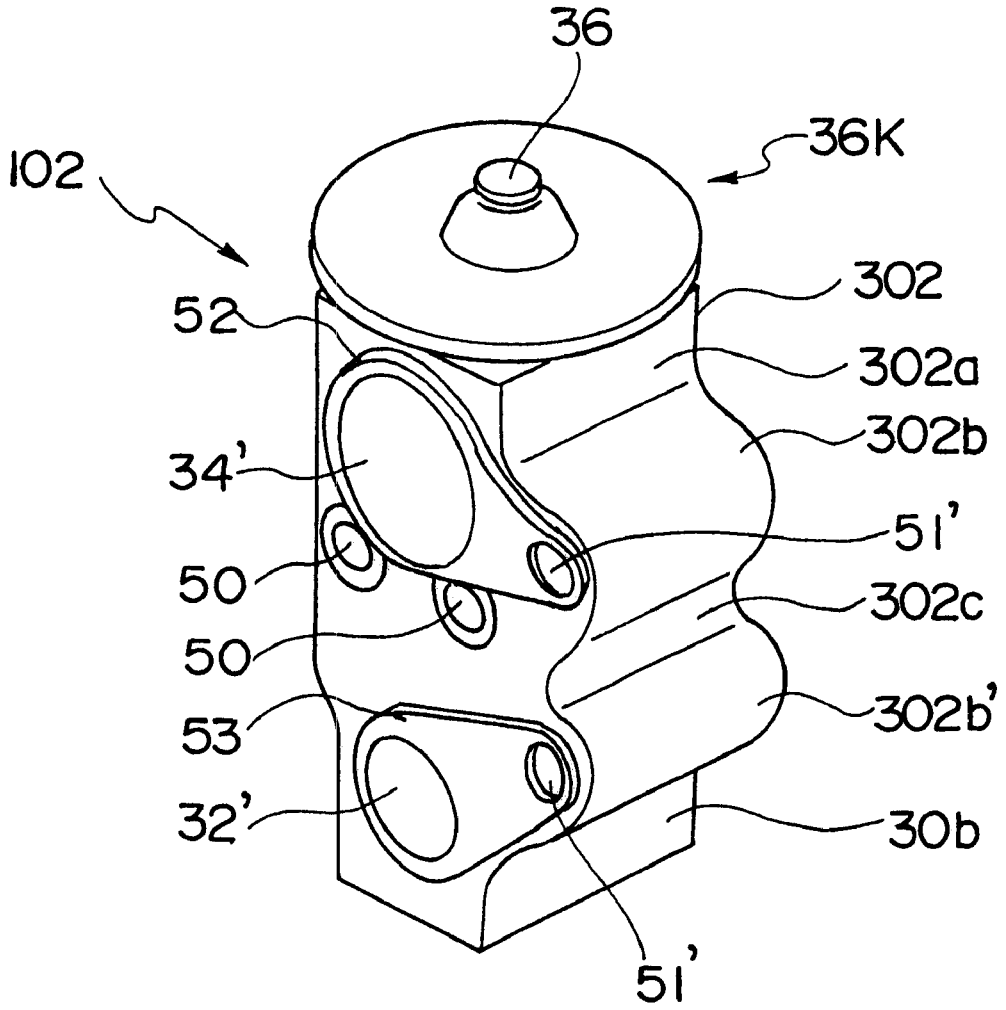
FIG. 12 is a schematic view showing the embodiment of connecting the piping to the expansion valve of FIG. 9.

FIG. 12 shows an embodiment of the expansion valve according to the present invention, wherein the expansion valve according to the embodiment shown in FIG. 9 is connected to the piping through the mounting holes 51. The same reference numbers as FIG. 9 show either the same or equivalent components.

In the drawing, numbers 52 and 53 show plate-like pipe mounting members, and the pipe mounting members 53 and 52 comprise penetrating holes 32' and 51' each corresponding to the first passage 32 and the mounting hole 51, and penetrating holes 34' and 51' each corresponding to the second passage 34 and the mounting hole 51, respectively. The predetermined piping corresponding to each refrigerant passage (not shown) is connected at its end portion to the first passage 32 and the second passage 34 respectively through penetrating holes 32' and 34', as similar to the prior art. A bolt (not shown) is inserted to the mounting holes 51 through penetrating holes 51' corresponding to each mounting hole, and the bolts are either fixed to the mounting holes 51, or screwed to the screw portion of the mounting holes 51. Thereby, the mounting member 53 is positioned so as to cover the first passage 32 and the mounting hole 51, and the mounting member 52 is fixed to cover the second passage 34 and the mounting hole 51 of the expansion valve 102, thereby supporting the predetermined piping.

Further, the holes marked 58 in FIGS. 9 and 10 are holes for inserting the positioning pins of mounting members 52 and 53, which can also be omitted. By utilizing mounting holes 51 formed respectively on protruding portions 302*b* and 302*b'*, the piping to be connected to the first passage 32 and the second passage 34 may be mounted appropriately by the mounting members 52 and 53 to the expansion valve 102 fixed to a predetermined position, for example to the evaporator, by the penetrating holes 50. According to the present embodiment, the degree of freedom in positioning the piping is increased, the fixing operation of the piping to an expansion valve for air-conditioning devices in vehicles which allow only small working space and limited mounting space may be eased, and therefore, the working condition of the mounting of pipes may be improved.

Moreover, according to the present invention, the shape of the protruding portions, where the mounting holes for the pipe mounting member are to be formed, is not limited to the shape of the embodiment shown in FIG. 9, but may be formed to have a prismatic projection.

Figure 13:
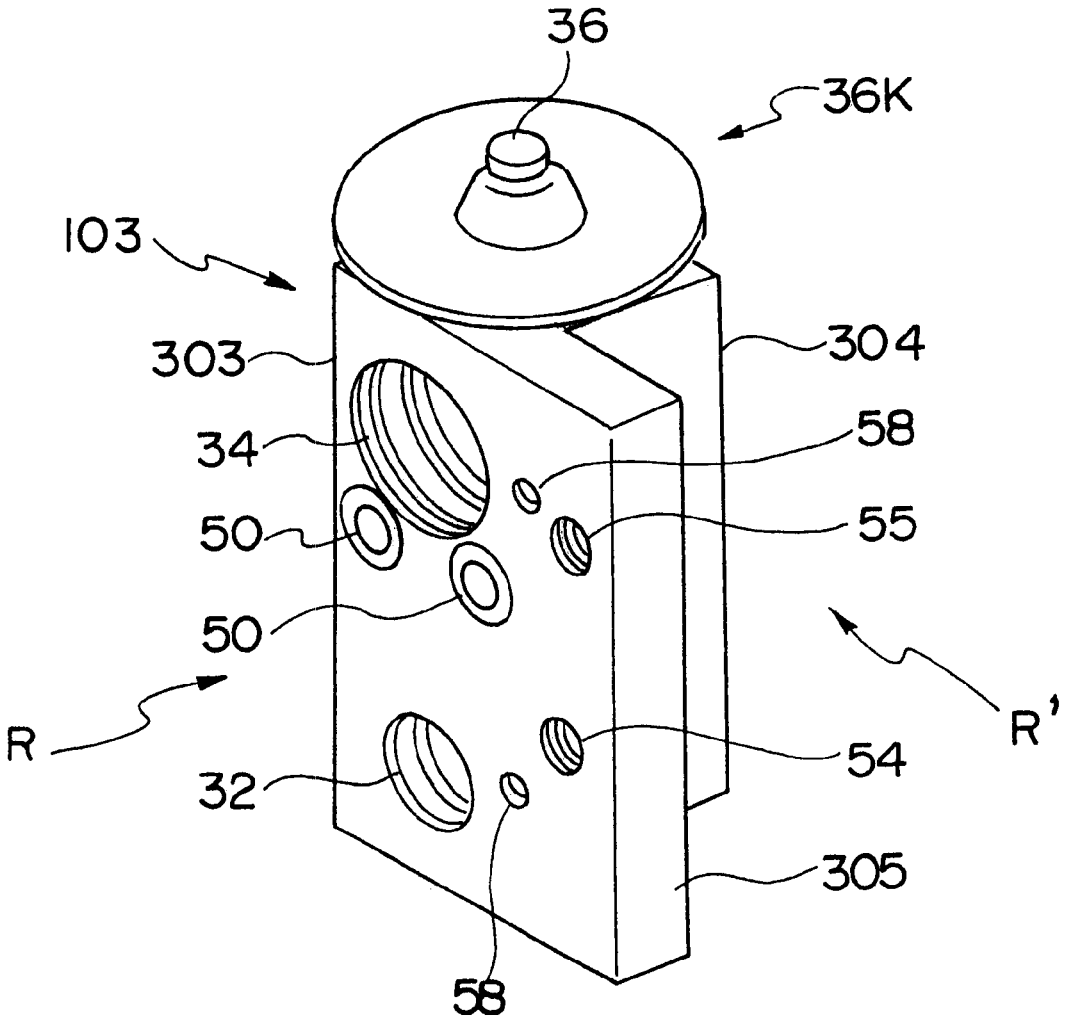
FIG. 13 is a schematic view showing yet another embodiment of the expansion valve according to the present invention.
Figure 14:
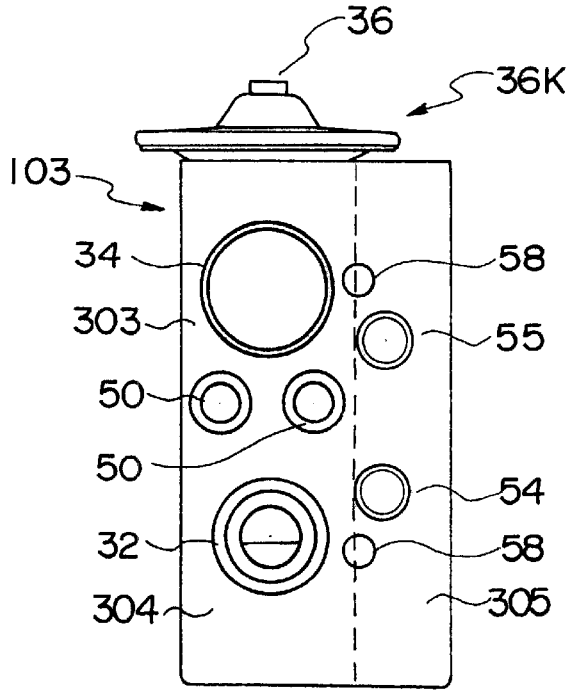
FIG. 14 is a front view of FIG. 13.
Figure 15:
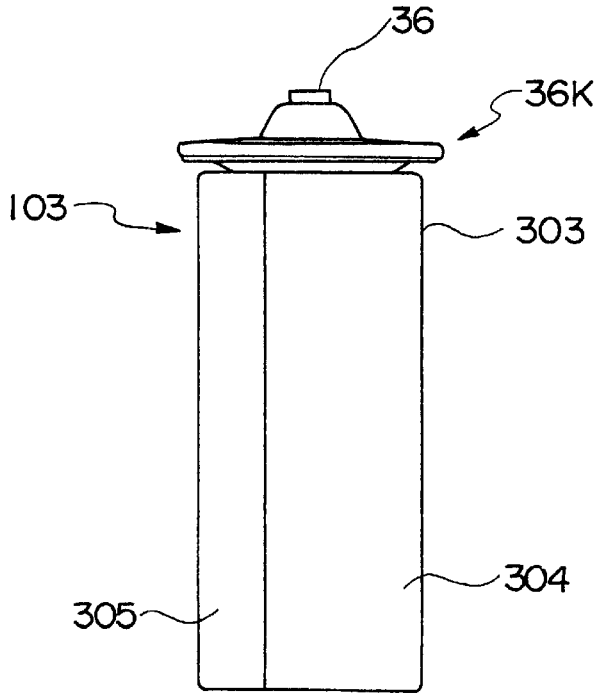
FIG. 15 is a side view of FIG. 13.

FIG. 13 shows another embodiment of the expansion valve according to the present invention with prismatic shaped protruding portions, wherein FIG. 13 is a schematic view omitting the internal structure thereof, FIG. 14 is a front view taken from direction arrow R of FIG. 13, and FIG. 15 is a side view taken from direction arrow R' of FIG. 13. The internal structure of the expansion valve is the same as that of FIG. 1. The expansion valve 103 of FIGS. 13–15 only differ from the embodiment of FIG. 9 in the shape of the valve body 303, and the other components are the same. The same or equivalent portions are marked by the same reference numbers, and the explanation thereof are omitted.

In FIGS. 13 through 15, the valve body 303 of the expansion valve 103 comprises a first passage 32, a second passage 34 and penetrating holes 50. The body further comprises a prismatic-shaped body portion 304 and a prismatic-shaped projection 305 formed integrally thereto, wherein mounting holes 54 and 55 each corresponding to the first passage 32 and the second passage 34 are formed on the projection 305. The body portion 304 is formed integrally with the projection 305 as the valve body 303 by an extrusion molding performed to the direction crossing said each refrigerant passages at right angles.

The extrusion molding is performed by molding, for example, an aluminum alloy. Thereby, the body portion 304 and the projection 305 may be formed integrally at the time of manufacture of the base-shape material. Thereafter, the material is cut to an appropriate length as the valve body 303, and the first passage 32, the second passage 34 and the penetrating holes 50 are formed to the body portion 304 by hole processing. Further, mounting holes 54 and 55 are formed respectively to their predetermined positions on the projection 305 by hole processing. The mounting holes 54 and 55 may also be formed by screw processing. In the above-mentioned embodiments, the valve body 302 and 303 are each assembled with a power element portion 36K, and with the internal structure formed thereto, they become expansion valves 102 and 103.

Figure 16:
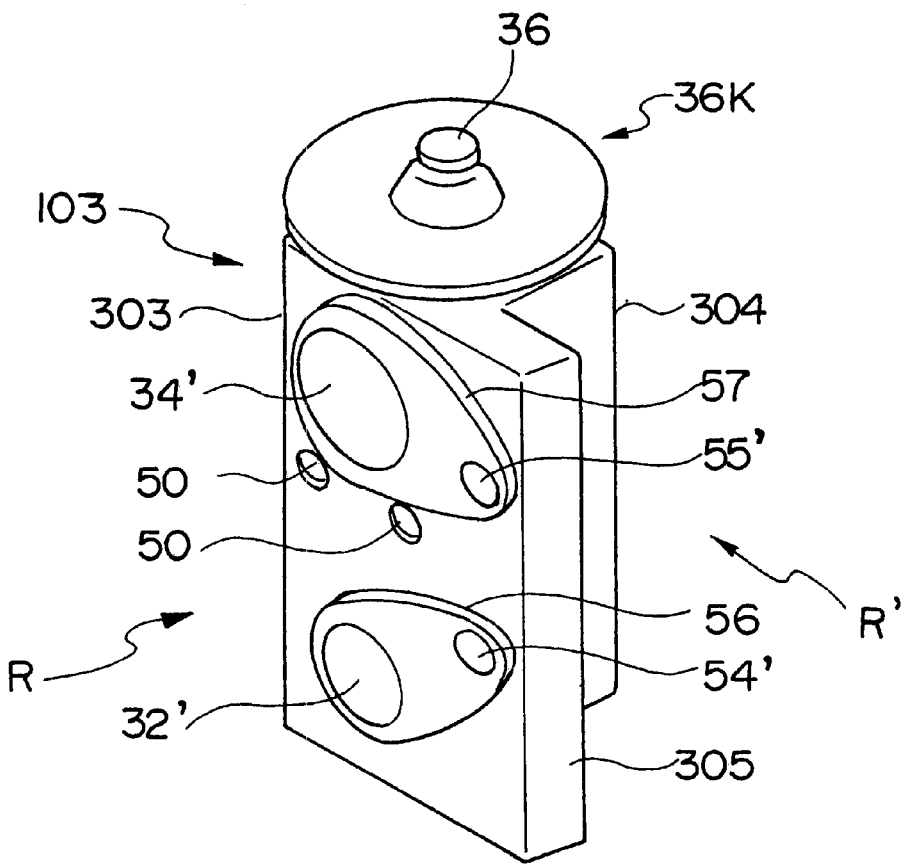
FIG. 16 is a schematic view showing an embodiment of connecting the piping to the expansion valve of FIG. 13.
Figure 17:
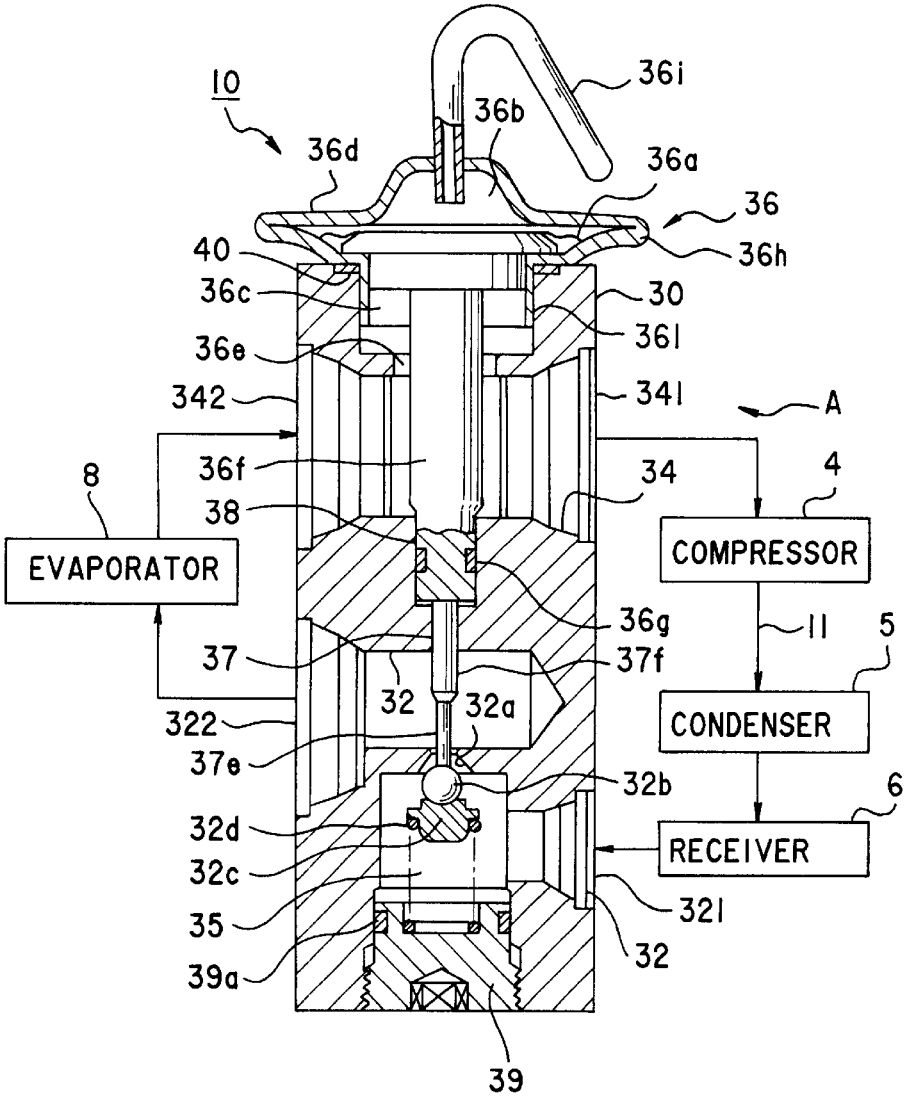
Fig.17 PRIOR ART
FIG. 17 is an explanatory view showing the prior art expansion valve in cross-section together with an outline of the refrigeration cycle.
Figure 18:
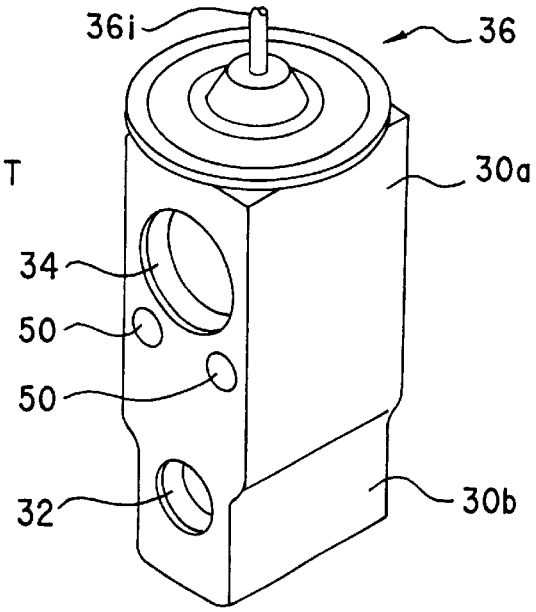
Fig.18 PRIOR ART
FIG. 18 is a schematic view of the prior art expansion valve.
Figure 19:
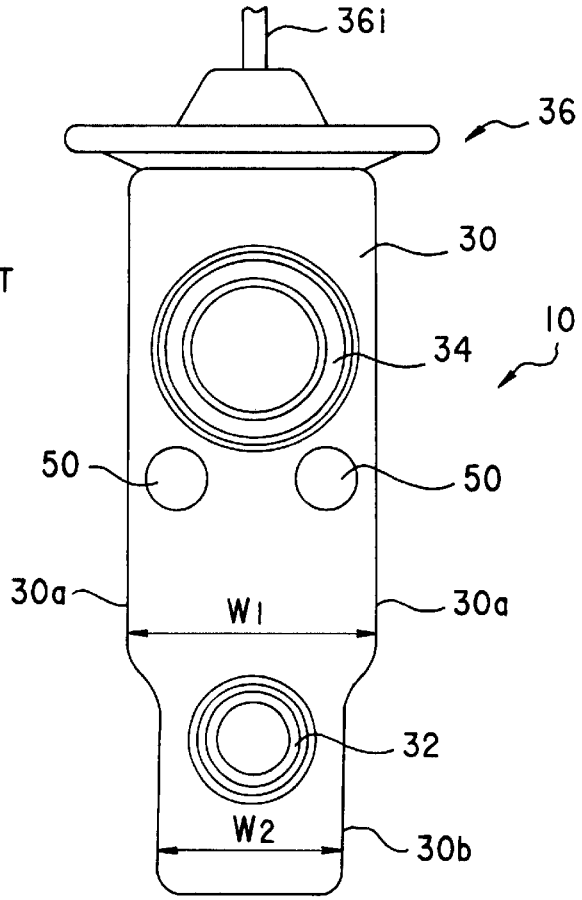
Fig.19 PRIOR ART
FIG. 19 is a front view of the prior art expansion valve.
Figure 20:
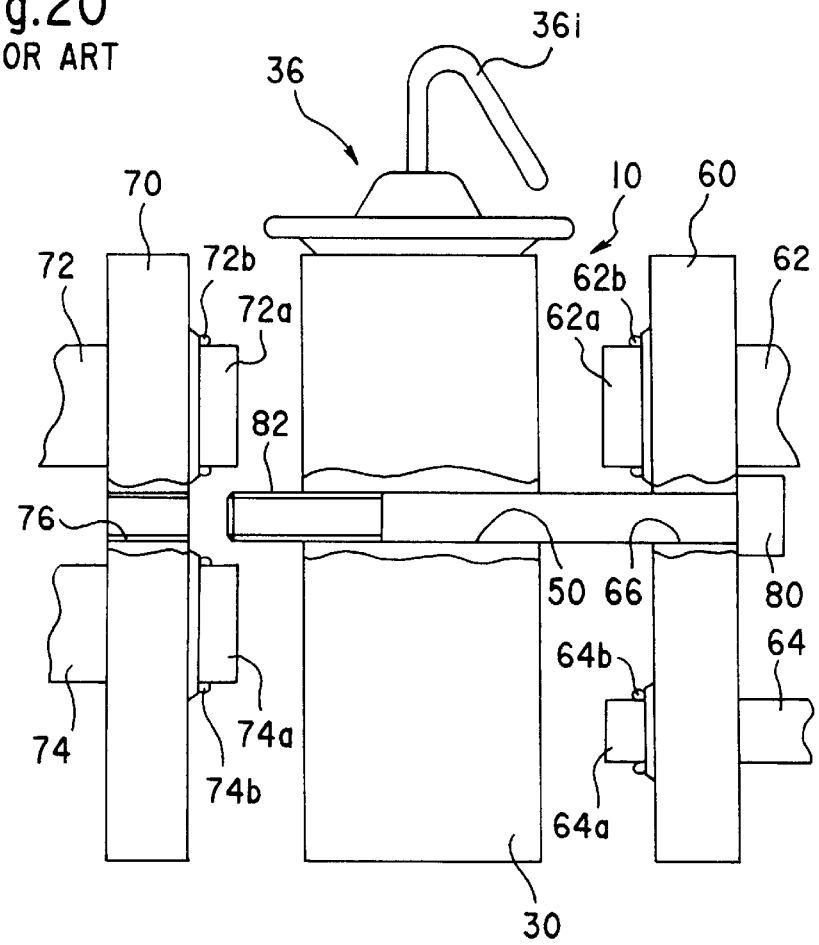
Fig.20 PRIOR ART
FIG. 20 is an explanatory view of the mounting structure of the expansion valve.
Figure 21:
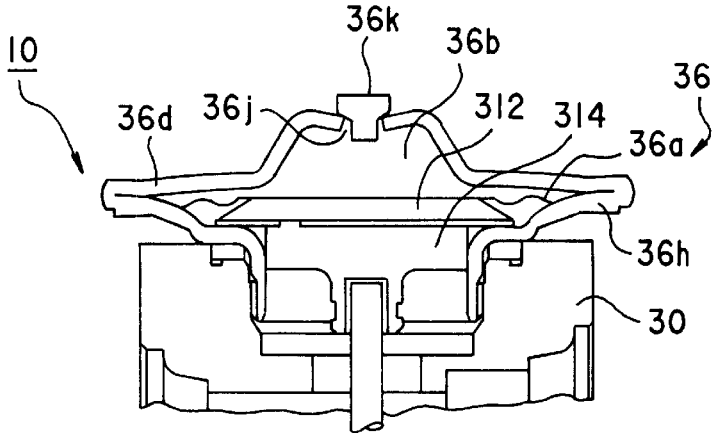
Fig.21 PRIOR ART
FIG. 21 is an explanatory view of the power element portion.
Figure 22:
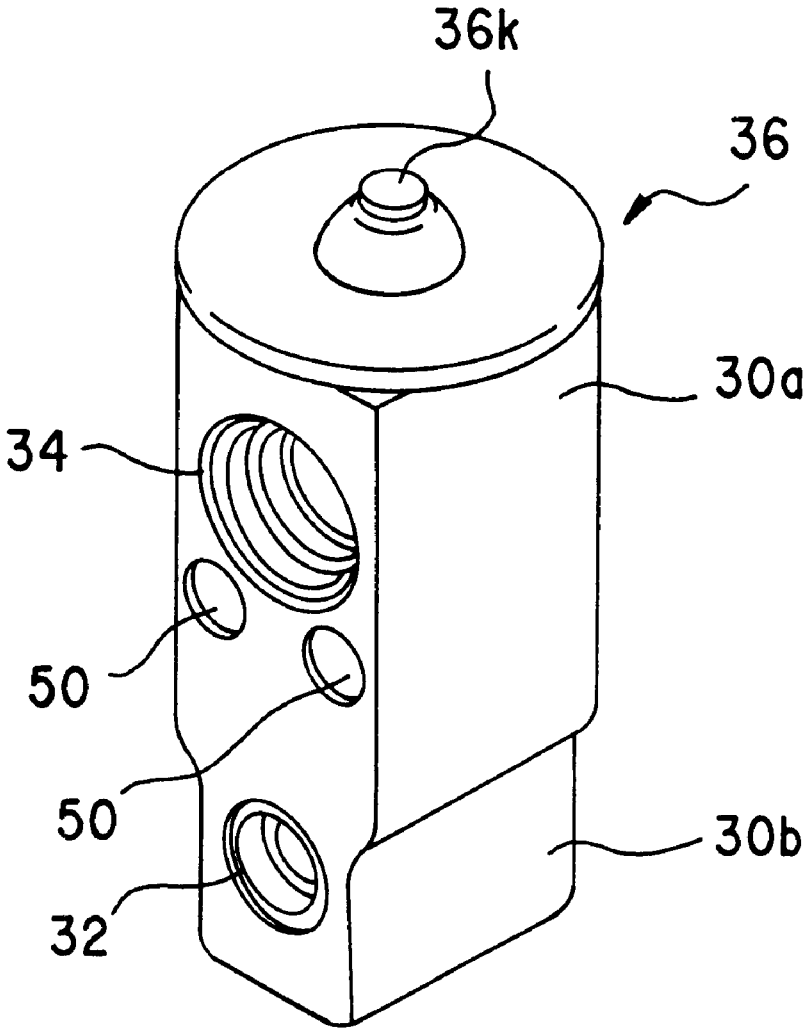
Fig.22 PRIOR ART
FIG. 22 is a schematic view of the prior art expansion valve.

FIG. 16 shows an embodiment of the present expansion valve wherein pipes are connected to the expansion valve according to the embodiment shown in FIG. 13 through mounting holes 54 and 55. The same reference numbers as FIG. 13 refer to either the same or equivalent components.

In the drawing, reference numbers 56 and 57 show plate-like pipe mounting members. The pipe mounting member 56 and the pipe mounting member 57 are equipped with penetrating holes 32' and 54' each corresponding to the first passage 32 and the mounting hole 54, and penetrating holes 34' and 55, corresponding to the second passage 34 and the mounting hole 55, respectively. The predetermined pipes (not shown) corresponding to each of the refrigerant passages are connected at its tip portion through the penetrating holes 32' and 34' to each refrigerant passage, similarly as with the prior art. Further, bolts (not shown) are inserted to mounting holes 54 and 55 through penetrating holes 54' and 55' corresponding to each mounting hole, so as to be fixed to the mounting holes 54 and 55, or to be screwed onto the screw portion of the mounting holes 54 and 55. Thereby, the mounting member 56 is fixed to the expansion valve 103 so as to cover the first passage 32 and the mounting hole 54, and the mounting member 57 is fixed to the expansion valve 103 so as to cover the second passage 34 and the mounting hole 55, thereby supporting predetermined pipes respectively.

Further, reference number 58 in FIGS. 13 and 14 show holes for inserting positioning pins of mounting members 56 and 57, which may be omitted. By utilizing the mounting holes 54 and 55 formed to the projection 305, the pipes to be connected to the first passage 32 and the second passage 34 may be positioned appropriately against the expansion valve 103, fixed through the penetrating holes 50 to a predetermined position, by use of mounting members 56 and 57. According to the present embodiment, the degree of freedom in positioning the piping is increased, and the mounting and positioning of the piping to an expansion valve for air-conditioning devices in vehicles which allow only small working space and limited mounting space may be eased.

According to the above embodiments, the degree of protrusion of the protruding portions or the projection may be determined to appropriate sizes according to need. For example, the degree of protrusion may be increased by increasing the depth of the concave portion of the protruding portion.

As explained above, the expansion valve according to the present invention include protruding portions formed integrally to the side surfaces of the valve body in the expansion valve, which enable to provide a large degree of freedom in the positioning of the penetrating mounting holes to be formed on the valve body.

Moreover, in the present expansion valve, not only the above-mentioned protruding portions but also a plurality of narrow portions may be formed. This enables to decrease the manufacturing cost of the expansion valve, and at the same time, enables to reduce the size and lighten the weight of the expansion valve.

Further, according to the present expansion valve, the degree of freedom in the connecting of pipes to the expansion valve will be increased, the mounting operation thereof may be simplified, and the working performance as a whole may be improved.

What is claimed is:

1. An expansion valve comprising a valve body, a valve means movable along an axis of said valve body for adjusting the flow rate of a refrigerant traveling through a first passage formed inside said valve body from a compressor toward an evaporator, and a power element portion for driving said valve means according to the temperature of the refrigerant traveling through a second passage formed inside said valve body from said evaporator toward a compressor, wherein said expansion valve includes protruding portions formed integrally to the side surface of said valve body and projecting laterally therefrom, said protruding portions containing through-holes extending substantially orthogonally with respect to said valve body axis for mounting said expansion valve.

2. An expansion valve according to claim 1, wherein said valve body further comprises a first narrow portion where a lower portion of said body opposite to an upper portion to which said power element portion will be mounted is formed to have a narrow width, and a second narrow portion where the area of the valve body between said first narrow portion and said protruding portion is formed to have a narrow width.

3. An expansion valve according to claim 2, wherein said valve body further comprises a third narrow portion where the area between said protruding portion and said power element portion is formed to have a narrow width.

* * * * *